United States Patent [19]

Bernheim et al.

[11] Patent Number: 4,737,239

[45] Date of Patent: Apr. 12, 1988

[54] PROCESS FOR THE MANUFACTURE OF PAPER OR CARDBOARD WHICH IS SIZED UNDER ALKALINE OR NEUTRAL CONDITIONS WITH ANIONIC HYDROPHOBIC SIZING AGENTS AND CATIONIC RETENTION AIDS

[75] Inventors: Michael Bernheim, Aystetten, Fed. Rep. of Germany; Hubert Meindl, Riehen; Peter Rohringer, Schönenbuch, both of Switzerland

[73] Assignee: Ciba-Geigy Corporation, Ardsley, N.Y.

[21] Appl. No.: 773,708

[22] Filed: Sep. 9, 1985

[30] Foreign Application Priority Data

Sep. 13, 1984 [CH] Switzerland ..... 4377/84

[51] Int. Cl.[4] ..... D21H 3/08

[52] U.S. Cl. ..... 162/158; 162/164.3; 162/164.6; 162/166; 162/167; 162/168.2; 162/175; 162/178; 162/179; 162/181.1

[58] Field of Search ..... 162/158, 179, 168.2, 162/135, 164.6, 166, 167, 175, 178, 181.1, 164.3; 106/243, 287.25; 427/395

[56] References Cited

U.S. PATENT DOCUMENTS

| | | | |
|---|---|---|---|
| 2,272,466 | 2/1942 | Hummel et al. . | |
| 2,693,490 | 11/1954 | Eilar . | |
| 3,173,945 | 3/1965 | Andress, Jr. et al. . | |
| 3,231,607 | 1/1966 | Hotten . | |
| 3,262,955 | 7/1966 | Gee et al. . | |
| 3,396,121 | 8/1968 | Miksch et al. | 162/158 |
| 3,403,113 | 9/1968 | Dietholm et al. . | |
| 3,491,064 | 1/1970 | Enders et al. . | |
| 3,509,098 | 4/1970 | Curchod et al. . | |
| 3,652,563 | 3/1972 | Petersen et al. | 162/158 |
| 3,700,623 | 10/1972 | Kolm . | |
| 3,821,075 | 6/1974 | Bills | 162/179 |
| 3,857,879 | 12/1974 | Abramitis . | |
| 3,931,063 | 1/1976 | Renner . | |
| 4,034,040 | 7/1977 | Cronin et al. . | |
| 4,065,349 | 12/1977 | Bateman et al. . | |
| 4,279,794 | 7/1981 | Dumas . | |
| 4,402,708 | 9/1983 | Oswald . | |

FOREIGN PATENT DOCUMENTS

| | | | |
|---|---|---|---|
| 96654 | 12/1983 | European Pat. Off. | 162/179 |
| 2459165 | 6/1976 | Fed. Rep. of Germany . | |
| 865727 | 4/1961 | United Kingdom . | |
| 1043437 | 9/1966 | United Kingdom . | |
| 1125486 | 8/1968 | United Kingdom . | |
| 1318244 | 5/1973 | United Kingdom . | |
| 1533434 | 11/1978 | United Kingdom . | |
| 1591199 | 6/1981 | United Kingdom . | |

OTHER PUBLICATIONS

J. P. Casey "Pulp and Paper", vol. III, 3rd Ed., 1981, pp. 1577–1592.

Chem. Abstract, vol. 85 (1976), 85:12670d.

CTFA Cosmetic Ingredient Dictionary, 3rd Edition (1982).

Tappi, vol. 57, No. 1 (Jan. 1974), pp. 97–100.

Tappi, vol. 64 (Jun. 1981), pp. 57–61.

Pulp and Paper Chemistry and Chemical Technology, James P. Casey, 20 Surface Sizing, Merchant L. Cushing, p. 1667.

Casey, *Pulp and Paper*, vol. III (1981), pp. 1574, 1602, 1603, 1604, 1914, 1915.

*Primary Examiner*—Peter Chin

*Attorney, Agent, or Firm*—Edward McC. Roberts

[57] ABSTRACT

Sizing agents devoid of anhydride groups, some of which are known and others are novel compounds, and which carry a single N,N-$C_6$–$C_{22}$alkyl(or alkenyl)amide group as hydrophobic substituent and at least one anionic group, in particular N,N-$C_6$–$C_{22}$dialkyl or N,N-$C_6$–$C_{22}$dialkenyl partial amides of a dicarboxylic acid, tricarboxylic acid or sulfocarboxylic acid, or the salts thereof, are particularly suitable, together with commercially available retention aids, for use in a process for pulp-sizing paper or cardboard at a pH of at least 6.5 of the fibre suspension, in the absence of e.g. aluminium sulfate, or in a process for surface-sizing paper.

14 Claims, No Drawings

PROCESS FOR THE MANUFACTURE OF PAPER OR CARDBOARD WHICH IS SIZED UNDER ALKALINE OR NEUTRAL CONDITIONS WITH ANIONIC HYDROPHOBIC SIZING AGENTS AND CATIONIC RETENTION AIDS

The present invention relates to a process for the manufacture of paper or cardboard which is sized in the pulp under alkaline or neutral conditions, which process comprises adding to the fibre suspension of at least pH 6.5 an anionic hydrophobic sizing agent and a cationic retention aid, which sizing agent contains e.g. an N,N-dialkylamido group of preferably 6 to 22 carbon atoms and at least one acid group, e.g. a carboxyl group.

A process for the manufacture of acid-sized paper or cardboard is known from German "Offenlegungsschrift" No. 2,459,165, which process comprises adding an anionic hydrophobic sizing agent and a cationic retention aid to the fibre suspension of pH 3.5 to 6.5 which contains aluminium sulfate, said sizing agent containing e.g. an N,N-dialkylamido group of 8 to 30 carbon atoms in each alkyl moiety and an acid carboxyl group, and preferably having the formula $$(n\text{-}C_{18}H_{37})_2\text{—N—CO—CH=CH—COOH or} \quad (I)$$

$$(n\text{-}C_{18}H_{37})_2\text{—N—CO—}(CH_2)_3\text{—COOH.} \quad (II)$$

It is known that considerable disadvantages must be accepted when manufacturing paper under acid conditions, for example the insufficient storage stability and mechanical strength of the acid-sized paper, the acid waste-waters resulting from the process, and the use of relatively expensive fillers such as kaolin or montmorillonite which have to be added on account of the acid pH value of the fibre-suspensions. The acid pH value of the fibre suspension may also cause corrosion in sensitive paper machines and, in addition, rules out the addition of inexpensive fillers such as calcium carbonate, especially chalk. As chalk imparts a high degree of whiteness to the sized paper, a disproportionately large amount of fluorescent whitening agent has to be added in the process for the manufacture of acid-sized paper so as to obtain a sufficiently high degree of whiteness. Finally, it must be mentioned that, according to German "Offenlegungsschrift" No. 2,459,165, relatively large amounts of the sizing agent, e.g. that of formula I or II, are required for processing fibre suspensions to paper.

In the process of this invention for the manufacture of paper which is sized under alkaline or neutral conditions, these shortcomings are avoided by adjusting the pH value of the fibre suspension to at least 6.5 in the absence of acids, e.g. sulfuric acid or formic acid or, in particular, of e.g. latent acid sulfates such as aluminium sulfate (alum). In particular, sized paper of increased storage stability is obtained with a relatively small amount of sizing agent.

Accordingly, the present invention relates to a process for sizing paper or cardboard under alkaline or neutral conditions i.e. for the manufacture of alkaline-sized or neutral-sized paper or cardboard, which comprises adding to aqueous cellulose-containing fibre suspensions which may or may not contain fillers and, in the absence of acids of latent acid sulfates such as aluminium sulfate, have a pH value of at least 6.5, preferably of at least 7.0, in any order or simultaneously, at least.

(A) one sizing agent devoid of anhydride groups that carries a single N,N-dialkylamido or N,N-dialkenylamido group containing at least 6 carbon atoms in the alkyl or alkenyl moieties respectively as hydrophobic substituent and at least one anionic group in salt form or in acid, i.e. free, form, and (B) one polymeric cationic retention aid.

Further objects of the invention are:

the aqueous compositions for carrying out the paper sizing process, which compositions contain, if the sizing agent (A) and the retention aid (B) are added separately, in any order, to the fibre suspension for pulp sizing, only the sizing agent (A) which is at least partly in salt form, together with optional conventional auxiliaries, or, if the sizing agent (A) and the retention aid (B) are added simultaneously to the fibre suspension, contain the sizing agent (A) which may be at least partially in salt form as well as the retention aid (B), together with optional conventional auxiliaries, the paper or cardboard sized by the process of the present invention, and the use of the sizing agent (A) of the indicated kind for sizing paper or cardboard.

Some of the sizing agents (A) are novel compounds which, together with the process for their preparation, likewise constitute further objects of the invention.

As salient feature, the sizing agents (A) of this invention normally contain 1, 2 or 3 anionic groups which are usually in the form of acid carboxyl, hydroxy or sulfo groups, with sulfo groups, in particular carboxyl groups, being preferred. Sizing agents which contain two such anionic groups or, preferably, only one such group, are preferred. Such groups are preferably in salt form, e.g. as amine, ammonium or sodium salts, in aqueous medium at pH values of at least 6.5, preferably of at least 7.0, of the fibre suspensions, and are able to form anions during the paper manufacture. Under the indicated conditions, the cationic retention aids (B) are for their part also able to form cations. The ability of the sizing agents to form anions and of the retention aids to form cations can also be termed anionic and cationic respectively. Thus the sizing agent the retention aids can also be termed anion-liberating sizing agents and cation-liberating retention aids.

The sizing agents (A) are also characterised by the feature that they contain a single N,N-dialkylamido or N,N-dialkenylamido group. Each of the two alkyl or alkenyl moieties of these N,N-dialkylamido or N,N-dialkenylamido groups, independently of the other, contain at least 6, in particular 6 to 22, preferably 11 to 22 and, most preferably, 16 to 20 carbon atoms. Alkyl groups are preferred to alkenyl groups. The hydrophobic substituents are derived in general from unsaturated or, preferably, saturated secondary fatty amines. Symmetrical secondary amines in which the two alkenyl or alkyl moieties are identical are preferred to the asymmetrical secondary amines in which the two alkyl or alkenyl moieties are different. The fatty amines are in turn derived from unsaturated or, preferably, saturated fatty acids of 6 to 22, preferably 11 to 22 and, most preferably, 16 to 20 carbon atoms. Such acids are for example capronic acid, preferably caprylic acid, lauric acid, myristic or myristoleic acid, palmitoleic acid, eleostearic acid, clupadonic acid, in particular oleic acid, elaidic acid, erucic acid, linolic acid and linoleic acid. Palmitic, stearic, oleic and behenic acid are particularly important, with palmitic and stearic acid being preferred. Also suitable are readily accessible technical, mixtures of these fatty acids. Synthetic fatty acids which are prepared e.g. by oxosynthesis also fall within the above definition.

Representative examples of preferred symmetrical secondary amines from which the N,N-dialkylamido or N,N-dialkenylamido groups of the sizing agents of this invention are derived are: dihexylamine, dioctylamine (also called dicaprylamine) and, in particular, didodecylamine, dihexadecylamine and dioctadecenylamine (also called dilaurylamine, dipalmitylamine and dioleylamine respectively).

Because of its ready accessibility, dioctadecylamine (also called distearylamine) is particularly preferred. Commercially available technical mixtures of fatty amines of the indicated kind are particularly suitable. A preferred mixture of this kind is e.g. ARMEEN® 2 HT, which is a technical mixture of amines with an average molecular weight of 500 and which contains distearylamine as main component, together with other symmetrical and asymmetrical secondary amines as secondary components, said secondary components containing e.g. oleyl, lauryl and palmityl radicals.

Symmetrical and asymmetrical secondary amines of the above kind can be obtained from the corresponding previously mentioned fatty acids by methods which are known per se, by reacting the fatty acid with e.g. ammonia to give the intermediate nitrile, which is subsequently reacted by catalytic hydrogenation to give the secondary amine.

The sizing agent employed as component (A) in the process of this invention and which contains 1 or 2 anionic groups of the indicated kind and a single N,N-dialkylamido or N,N-dialkenylamido group of the indicated kind are in general N,N-$C_6$-$C_{22}$dialkyl or N,N-$C_6$-$C_{22}$-dialkenyl partial amides of a dicarboxylic acid, tricarboxylic acid or sulfocarboxylic acid or of a salt thereof, which preferably have the formula

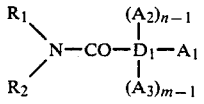

(1)

wherein $A_1$, $A_2$ and $A_3$ are each independently an anionic hydroxyl, carboxyl or sulfo group which may be in salt form or in acid, i.e. in the free form, $D_1$ is an aromatic or cycloaliphatic divalent unbranched or branched radical of 5 to 10 carbon atoms or unsubstituted or substituted alkylene or alkenylene of 2 to 6 carbon atoms, each of $R_1$ and $R_2$ independently of the other is $C_6$-$C_{22}$alkyl or $C_6$-$C_{22}$alkenyl, and n and m is each independently 1 or 2.

Aliphatic, cycloaliphatic or aromatic sizing agents of the formula (1), wherein $A_1$ is a sulfo or, preferably, a carboxyl group and $A_2$ and $A_3$ are each a hydroxyl or carboxyl group, and wherein the two alkyl or alkenyl radicals of the hydrophobic amide group are identical, are further preferred and accordingly have the formula

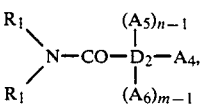

(2)

wherein $A_4$ is a sulfo or carboxyl group, each of $A_5$ and $A_6$ independently of the other is a hydroxyl or carboxyl group, which groups are in salt form as anionic groups or as acid, i.e. free, groups, $D_2$ is naphthylene, phenylene, di- or tetrahydrophenylene, cyclohexylene, norbornenylene, hexachloronorbornenylene, $C_2$-$C_4$alkenylene or $C_2$-$C_6$alkylene, and $R_1$, n and m have the given meanings.

In formula (2), phenylene is preferred to the other definitions of $D_2$ and a carboxyl group is preferred to a sulfo group as definition of $A_4$. If $D_2$ is phenylene, m is preferably 1, n is 1 as well as 2 and $A_5$ is preferably a carboxyl group. If $D_2$ is $C_2$-$C_6$alkenylene, n and m are preferably 1. However, both n and m are preferably 2 if $D_2$ is $C_2$-$C_6$alkylene, while $A_5$ and $A_6$ preferably have different meanings. Further, the two alkyl or alkenyl moieties of the hydrophobic amide group contain preferably 16 to 22 carbon atoms. Accordingly, preferred sizing agents employed as component (A) in the process of this invention are compounds which are optionally in the salt form and have the formula

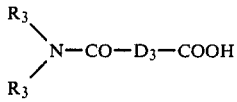

(3)

wherein $D_3$ is a divalent radical which is optionally in the salt form and has the formula

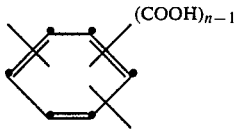

(3.1)

or

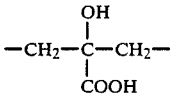

(3.2)

or is a divalent radical of the formula $$-CH_2-CH_2-, \quad (3.3)$$

$$-CH_2-CH_2-CH_2-, \quad (3.4)$$

$$-CH=CH-, \quad (3.5)$$

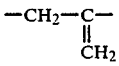

oder (3.6)

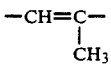

(3.7)

and $R_3$ is $C_{16}$-$C_{20}$alkyl or $C_{16}$-$C_{20}$alkenyl and n is 1 or 2.

Specific representatives of sizing agents of formula (3) are for example those of the formulae

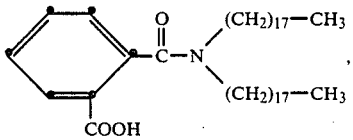

(4)

-continued

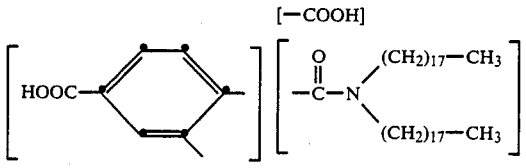

(5)

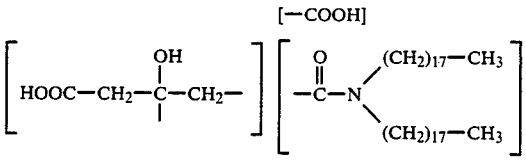

(6)

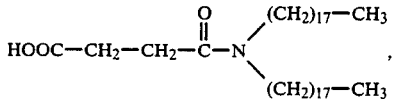

(7)

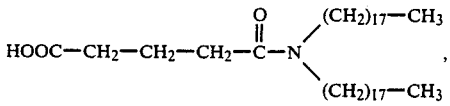

(8)

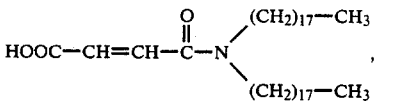

(9)

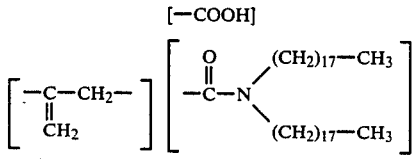

(10)

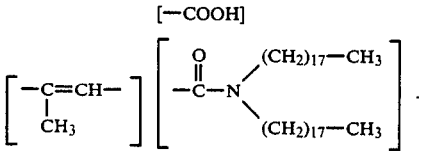

(11)

The sizing agents of formulae (5), (6), (10) and (11) are mixtures of isomers. Before their use as component (A) in the paper-sizing process of this invention, the sizing agents do not need to be purified by recrystallisation after their synthesis, but can normally be used direct, i.e. without further working up.

Especially when adding the sizing agent (A) and the retention aid (B) separately (in any order) to the fibre suspension in the process of this invention for sizing paper or cardboard, it is convenient to add the sizing agent at least partly in salt form. As required, such salts can be prepared by converting the sizing agents (A), after their synthesis, wholly or partly into the corresponding salts by adding e.g. an alkylamine or alkanolamine containing a total of not more than 6 carbon atoms, e.g. trimethylamine, triethylamine, monethanolamine or diethanolamine, preferably by adding ammonia or an alkali metal hydroxide, for example potassium hydroxide or, in particular, sodium hydroxide, normally in aqueous medium at room temperature (from about 15° to 25° C.). It is convenient to use an alkali metal hydroxide, e.g. potassium hydroxide or, preferably, sodium hydroxide, or especially ammonia, usually in the form of a dilute aqueous solution (about 1 to 10% by weight). It is advantageous to use generally not more than 3 moles, preferably from 0.1 to 1.5 moles and, most preferably, 0.9 to 1.1 moles of ammonia or alkali metal hydroxide per available acid group of the sizing agent. The sizing agents obtained in the form of their salts thus contain acid carboxyl, hydroxyl or sulfo groups which are at least partly converted into the $-COO^{\ominus}M^{\oplus}$, $O^{\ominus}M^{\oplus}$ or $SO_3^{\ominus}M^{\oplus}$ group, wherein $M^{\oplus}$ denotes the corresponding amine, ammonium or alkali metal cations.

Preferred sizing agents (A) of the indicated kind have molecular weight of about 250 to 1000, preferably from about 500 to 750, and, because they contain at least one acid group of the indicated kind, have an acid number (mg of KOH/g of substance) of about 55 to 320, preferably of about 70 to 180.

As already indicated, some of the sizing agents used as component (A) in the paper sizing process of this invention are compounds which are known per se and some are novel compounds which can be prepared by methods which are known per se.

Thus, for example, the compound of formula (4) is disclosed in U.S. Pat. No. 4,402,708 as additive for fuel oils. This patent, however, makes no mention of analogous compounds containing two carboxyl groups, i.e. of compounds of formula (3), wherein $D_3$ is the radical of formula (3.1) and n in formula (3.1) is 2, and, in particular, of compounds of formula (5). Further, U.S. Pat. No. 4,034,040 discloses compounds of formula (3), wherein $D_3$ is lower alkylene of preferably not more than 4 carbon atoms and, in particular, the compounds of formulae (6) and (7), as agents for combating viral infections. Finally, German "Offenlegungsschrift" No. 2,459,165 already referred to discloses compounds of formula (9), but makes no mention of compounds of formulae (10) and (11).

Accordingly, those compounds are novel per se which are optionally in the salt form and have e.g. the formula

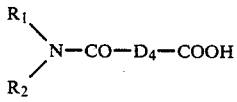

(12)

wherein $D_4$ is a divalent radical which is optionally in the salt form and has the formula

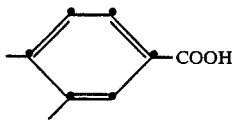

(12.1)

or the formula (3.2), or is a divalent radical of the formula (3.6) or (3.7), and $R_1$ and $R_2$ differ from each other or are preferably identical and are each $C_6$–$C_{22}$alkyl or $C_6$–$C_{22}$alkenyl. The process for the preparation of these compounds comprises reacting a secondary asymmetrical or preferably symmetrical amine of the formula

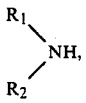

(13)

wherein $R_1$ and $R_2$ differ from each other or are preferably identical and are each $C_6$–$C_{22}$alkyl or $C_6$–$C_{22}$alkenyl, with trimellitic anhydride, citric acid, itaconic anhydride or citric anhydride, normally in about equimolar amounts.

In the paper sizing process of this invention, a polymeric cationic retention agent (B), which normally has a molecular weight of about at least 1000, preferably about 2000 to 2,000,000, is always used in addition to the novel anionic or acid sizing agent (A). Retention aids having a molecular weight in the range from 10,000 to 100,000 are particularly preferred. In principle, any commercially available retention aid is suitable for use in the process of this invention. Examples of conventional retention aids (B) which are particularly suitable for use, together with the sizing agent (A), in the process of this invention, are polyalkylenimines, adducts of epihalohydrin with reaction products of polyalkylenepolyamines and aliphatic dicarboxylic acids; adducts of epihalohydrin with reaction products of polyalkylenepolyamines, dicyandiamide and organic dicarboxylic acids which are free or esterified with alkanols; reaction products of dicyandiamide, formaldehyde, ammonium salts of strong inorganic acids and alkylenediamines or polyalkylenepolyamines; cationically modified starches or carbohydrates from carob beam gum or guar gum; copolymers based on polyamide amines and reaction products of epihalohydrins and polymerised diallyl amines.

Preferred adducts of epichlorohydrin with reaction products of polyalkylenepolyamines and aliphatic dicarboxylic acids are described e.g. in British Pat. No. 865,727; adducts of epichlorohydrin with reaction products of dicyandiamide and diethylenetriamine or triethylenetetramine are described e.g. in German Offenlegungschrift No. 2,710,061 and in British Pat. No. 1,125,486; adducts of epichlorohydrin with reaction products of diethylenetriamine, dicyandiamide and dicarboxylic acids which are free or preferably esterified with lower alkanols, in particular dimethyl adipate, are described e.g. in British Pat. No. 1,125,486, and reaction products of dicyandimaide, formaldehyde, ammonium salts of strong inorganic acids and of ethylenediamine or triethylenetetraamine, are described e.g. in U.S. Pat. No. 3,491,064. Preferred cationically modified starches or carbohydrates from carob beam gum or guar gum are e.g. adducts of alkylene oxide with these starches or carbohydrates in which the alkylene oxide employed contains 2 or 3 carbon atoms in the alkylene moiety and quaternary ammonium groups. Copolymers based on polyamide amines have molecular weights of $10^3$ to $10^5$, preferably of $10^3$ to $10^4$, and are obtainable e.g. from aliphatic saturated dicarboxylic acides containing 2 to 10 carbon atoms, preferably 3 to 6 carbon atoms, preferably adipic acid, and polyalkylenepolyamines, e.g. polypropylenepolyamine and polyethylenepolyamine, preferably dimethylaminohydroxypropyl diethylenetriamine. They are described e.g. in the CTFA Cosmetic Ingredient Dictionary, 3rd edition 1982 (CFTA=Cosmetic Toiletry and Fragrance Association). Reaction products or epihalohydrins and polymerised diallyl amines preferably have molecular weights of 1000 to 2000 and are described e.g. in U.S. Pat. Nos. 3,700,623 and 4,729,794.

Typical examples of preferred retention aids (B) which are used together with the sizing agents (A) in the paper sizing process of this invention are a maize or potato starch modified with a propylene oxide which contains quaternary ammonium groups, a 25% suspension of which in distilled water at 20° C. has a pH of 4.2 to 4.6, a polyethylenimine having a molecular weight of 10,000 to 100,000, an adduct of epichlorohydrin with a reaction product of triethylenetetraamine and dicyandiamide, an adduct of epichlorohydrin with a reaction product of diethylenetriamine, dicyandiamide and dimethyl adipate, a reaction product of diacyandiamide, formaldehyde, ammonium chloride and ethylenediamine, an adduct of epichlorohydrin with a poly-N-methyl diallyl amine, and a copolymer of adipic acid and dimethylaminohydroxypropyl diethylenetriamine.

In the process of this invention for the pulp sizing of paper or cardboard, 0.02 to 3, preferably 0.05 to 3, in particular 0.1 to 0.8 percent by weight of the sizing agent (A), and 0.02 to 3, preferably 0.05 to 3, in particular 0.1 to 0.4 percent by weight of the retention aid (B) will normally be used, said amounts both being expressed as solids in (A) and (B) and based on the solids content of the fibre suspension. An amount of 0.02 to about 0.05 percent by weight of the sizing agent (A) and of the retention aid (B) suffices only for the size press control which is not ascertainable by means of conventional sizing tests (c.f. for example the article "Control and Understanding of Size Press Pickup" by D. R. Dill in TAPPI Journal Vol. 57, No. 1, of January 1974, pp. 97–100) (TAPPI=Proceedings of the Technical Association of the Pulp and Paper Industry). The fibre suspension to which the sizing agent (A) and the retention aid (B) are added normally has a solids content of 0.1 to 5, preferably 0.3 to 3, most preferably 0.3 to 1 percent by weight, and a Schopper-Riegler freeness of about 10° to 60°, in particular 20° to 60°, preferably 20° to 45° and, most preferably, 25° to 35°. The suspension usually contains pulp, especially pulp obtained from coniferous wood, such as pinewood, or from hardwood, i.e. deciduous wood, such as beechwood, which pulp is prepared by conventional methods, e.g. by the sulfite process or, in particular, the sulfate process. In addition, the fibre suspension may contain groundwood. The fibre suspension may also contain waste paper. Also suitable are pulp suspensions which are prepared by the CMP or CTMP process (chemimechanical and chemithermomechanical pulping processes, c.f. for example the article "Developments in Refiner Mechanical Pulping" by S. A. Collicut and co-workers in TAPPI, Vol. 64, No. 6, of June 1981, pp. 57–61).

The fibre suspension can additionally contain organic or mineral fillers. Suitable organic fillers are e.g. synthetic pigments, for example polycondensates of urea or melamine and formaldehyde which have large specific surface areas, are in highly disperse form and are described e.g. in British Pat. Nos. 1,043,937 and 1,318,244, or mineral fillers such as titanium dioxide, calcium sulfate and, in particular talcum and/or chalk (calcium carbonate). The fibre suspension contains as a rule 0 to 40, preferably 5 to 25 and, most preferably, 15 to 20 percent by weight of the fillers of the indicated kind expressed as solids, based on the solids content of the fibre suspension.

Fibre suspensions which do not contain filler can have a wide pH range from e.g. 6.5 to 10.0, preferably from 7 to 10. Preferred fibre suspensions are those which have a pH range from about 7 to 9 by adding talcum, in particular calcium carbonate, most preferably chalk.

The fibre suspensions may also contain additives, e.g. starch or its degradation products, which increase the fibre/fibre bond or fibre/filler bond.

It is also possible to add high molecular weight polymers of the acrylic series, e.g. polyacrylamides, with molecular weights of over 1,000,000 to the fibre suspensions as auxiliaries for retaining pulp fibre microparticles. Minimal amounts of about 0.005 to 0.02 percent by weight, expressed as solids in the polymer and based on the solids content of the fibre suspensions, suffice for this purpose.

The fibre suspenion is further processed to paper or cardboard in the process of this invention, in a manner known per se, on sheet formers or, preferably, continuously in paper machines of conventional construction. After drying at about 100° to 140° C. for about ½ minute to 10 minutes, paper having a variable weight per unit area of e.g. 50 to 200 g/m$^2$ is obtained.

As mentioned at the outset, the aqueous composition for carrying out the paper sizing process of this invention contains the sizing agent (A), in addition to optional customary auxiliaries, provided the sizing agent and the retention aid (B) are added separately to the fibre suspension. In this case the composition contains the sizing agent entirely, or preferably partly, in salt form (obtained by concurrently using e.g. ammonia, or alkylamine or alkanolamine or an alkali metal hydroxide of the indicated kind in the ratios stated above). In general, such compositions contain 5 to 30 percent by weight, preferably 5 to 20 percent by weight, of the sizing agent which is at least partly in salt form, expressed as solids and based on the total weight of the aqueous composition.

On the other hand, if the sizing agent (A) and the retention aid (B) are added simultaneously to the fibre suspension the aqueous composition contains, in addition to the optional customary auxiliaries, (A) 2 to 40 percent by weight, preferably 5 to 30 percent by weight, and, most preferably, 5 to 10 percent by weight of sizing agent (calculated as solids), based on the total weight of the aqueous composition, which sizing agent is optionally in salt form, and (B) 0.1 to 20 percent by weight, preferably 0.5 to 10 percent by weight most preferably 3 to 8 percent by weight of retention aid (calculated as solids), based on the total weight of the aqueous composition.

The aqueous compositions of the indicated kind may contain surface-active compounds as customary auxiliaries, e.g. dispersants or also emulsifiers and/or water-soluble organic solvents. Examples of suitable dispersants and emulsifiers are conventional ligninsulfonates, lignincarboxylates, carboxymethyl cellulose, adducts of ethylene oxide and alkyl phenols, fatty amines, fatty alcohols or fatty acids, fatty acid esters of polyhydric alcohols, substituted benzimidazoles, or condensates of formaldehyde and aromatic sulfonic acids, preferably naphthalenesulfonic acids. Further surface-active compounds are preferably anionic surfactants, in particular sulfate surfactants, e.g. diethanolamine lauryl sulfate, sodium lauryl sulfate or ethoxylated lauryl sulfates. Possible water-soluble organic solvents are aliphatic ethers of 1 to 10 carbon atoms, e.g. dioxane, ethylene glycol n-butyl ether or diethylene glycol monobutyl ether, or alcohols of 1 to 4 carbon atoms, e.g. isopropanol, ethanol or methanol.

If the aqueous compositions contain auxiliaries of the indicated kind, the ratio of component (A) to auxiliaries in the compositions is 1:0.02 to 1:0.3, preferably 1:0.05 to 1:0.1, based on the solids content of the sizing agent and the auxiliaries.

The compositions are formulated in conventional manner by stirring the sizing agent (A) together with the retention aid (B), or the sizing agent (A), usually partly in salt form, by itself either in the melt state or preferably in the solid state, in particular in powder form, normally in the presence of glass beads and, if necessary, of an emulsifier (if the sizing agent is in the melt state) or a dispersant (if the sizing agent is in powder form), at a maximum temperature of 90°, preferably of about 50° to 85° C. if emulsions are prepared, and preferably at about 15° to 25° C. if dispersions are prepared, to give storage stable, homogeneous emulsions or, preferably, dispersions which can be further diluted. As the sizing agents together with the retention aids, or the sizing agents which are entirely or at least partly in salt form, are usually self-dispersing or self-emulsifying, the use of dispersants or emulsifiers is in general not absolutely necessary. This also applies to the optional use of solvents and/or surfactants, which are employed only if the storage stability of the dispersions or emulsions is insufficient.

In addition to the process for the manufacture of pulp-sized paper or cardboard under alkaline or neutral conditions, it is also possible to utilise a process for the manufacture of paper with sized surface, which comprises applying to paper a sizing liquor that contains components (A) and (B), for example by spraying, preferably by padding, normally at room temperature (15°–25° C.), and subsequently drying the impregnated paper in the temperature range from 60° to 140° C., preferably from 90° to 110° C., for 0.1 to 10 minutes, preferably for 2 to 6 minutes. The paper so obtained has a coating of sizing agent and retention aid of 50 to 150 mg/m$^2$, preferably of 60 to 120 mg/m$^2$. The paper to be sized is paper of any kind having any weight per unit area, for example paper and cardboard of unbleached sulfite or sulfate cellulose.

For surface-sizing paper, the requisite sizing liquor is prepared by diluting the emulsions or dispersions referred to above with water, which emulsions or dispersions contain the sizing agent (A) as well as the retention aid (B). The emulsions or dispersions are diluted such that the sizing liquor obtained contains (A) 0.02 to 0.4, preferably 0.05 to 3 and, most preferably, 0.05 to 1 percent by weight of sizing agent (calculated as solid), based on the total weight of said sizing liquor, said sizing agent being optionally in salt form, and (B) 0.01 to 0.2, preferably 0.05 to 0.1 and, most preferably, 0.3 to 0.8 percent by weight of retention aid (calculated as solid), based on the total weight of the aqueous sizing liquor.

An advantage of the process of this invention is that, for pulp-sizing, fibre suspensions of widely differing kind can be processed with relatively small amounts of sizing agent and retention aid, in simple manner, to give paper which has good sizing properties (alkali drop test, ink flotation time and, in particular, water absorption according to Cobb). This applies also to surface-sizing, in which the good sizing effects are obtained with small amounts of sizing agent and retention aid. In particular, these small amounts permit a rapid mode of operation, so that good surface-sizing effects are obtained in the drying temperature range from e.g. 90° to 110° C. over about 20 to 40 seconds. The paper which is pulp-sized by the process of this invention has good mechanical properties, i.e. good strength, especially good tear strength. A good reproducibility of the process is ensured in pulp-sizing as well as surface sizing. In particular, it is possible in pulp sizing to process fibre suspensions which contain groundwood or waste paper. The compatibility of the sizing agent employed in the process of the invention with different fillers, e.g. chalk and also with other additives of the indicated kind is also advantageous.

The sizing agents and retention aids employed in the process of this invention are readily compatible with the auxiliaries conventionally used in the paper manufacturing industry, for example dyes, pigments, binders, and especially fluorescent whitening agents and other auxiliaries, Further, the sizing agents and retention aids do not have an undesirable propensity to foam. In addition, the degree of whiteness of the sized paper is not materially affected by the sizing and may even be improved both in pulp-sizing and in surface-sizing. In particular, the surprisingly good storage stability of the sizing agent dispersions of the indicated kind is most advantageous.

In the following Manufacturing Instructions and working Examples, parts and percentages are by weight.

PREPARATION OF KNOWN COMPOUNDS AS SIZING AGENTS

Instruction A

A mixture of 14.8 parts (0.1 mole) of phthalic anhydride and 50 parts (0.1 mole) of a technical distearylamine (ARMEEN ® 2 HT) with an average molecular weight of 500 is heated to 95° C. and stirred for 2½ hours at this temperature to give a clear melt. The reaction mixture is further heated to 140° C. and stirred for 5 hours at this temperature. The reaction is then cooled, affording 44 parts of the compound corresponding essentially to formula (4) as a white powder with a melting point of 42°–45° C. Acid number: 100.

Instruction B

A solution of 5 parts (0.05 mole) of succinic anhydride in 70 parts of toluene is added to a solution of 25 parts (0.05 mole) of the technical distearylamine employed in Instruction A, whereupon the temperature of the reaction mixture rises to 61° C. The reaction mixture is further heated to 65° C. and stirred for 3 hours at this temperature. The reaction mixture is subsequently cooled to 20° C. and allowed to stand for 16 hours. The solvent is then removed by vacuum distillation, affording 29.4 parts of the compound corresponding essentially to formula (7) as an ochre powder with a melting point of 40°–53° C. Acid number: 92.

Instruction C 11.4 parts (0.1 mole) of glutaric anhydride and 50.0 parts (0.1 mole) of the technical distearylamine employed in Instruction A are dissolved in 180 parts of toluene and the solution is heated to reflux temperature of c. 111° C. and kept for 3 hours at this temperature. The solvent is then removed by vacuum distillation, affording 60.0 parts of the compound corresponding essentially to formula (8) as an ochre powder with a melting point of 49°–54° C. Acid number: 102.

Instruction D

A solution of 100 parts (0.2 mole) of the technical distearylamine employed in Instruction A is added over 40 minutes to a solution of 19.6 parts (0.2 mole) of maleic anhydride in 150 parts of chloroform, whereupon the temperature of the reaction mixture rises to 38° C. The reaction mixture is further heated to 45° C. and stirred at this temperature for 1 hour. The solvent is then removed by vacuum distillation, affording 115 parts of the compound corresponding essentially to formula (9) as a white powder with a melting point of 48°–53° C. Acid number: 96.

PREPARATION OF NOVEL COMPOUNDS AS SIZING AGENTS

Example 1

9.6 parts (0.05 mole) of trimellitic anhydride and 25 parts (0.5 mole) of the distearylamine employed in Instruction A are dissolved in 180 parts of a xylene mixture and the solution is heated to reflux temperature of c. 145° C. and stirred for 32 hours at this temperature. The solvent is then removed by vacuum distillation, affording 33 parts of the compound corresponding generally to formula (5) as a pale brown viscous wax with a melting point of 18°–24° C. Acid number: 168.

Example 2

21 parts (0.1 mole) of citric acid monohydrate are added to a solution of 50 parts (0.1 mole) of the technical distearylamineemployed in Instruction A in 150 parts of toluene. The reaction mixture is heated to reflux temperature of c. 111° C. while removing the water of reaction from the reaction mixture with a water separator (time required: c. 17 hours). The solvent is subsequently removed by vacuum distillation, affording 75 parts of the compound corresponding essentially to formula (6) as a pale brown paste. Acid number: 159.

Example 3

The procedure of Instruction C is repeated, using 11.2 parts (0.1 mole) of itaconic anhydride instead of 11.4 parts of glutaric anhydride, to give 60 parts of the compound corresponding essentially to formula (10) as a brownish powder with a melting point of 39°–40° C. Acid number: 88.

Example 4

The procedure of Instruction C is repeated, using 11.2 parts (0.1 mole) of citraconic anhydride instead of 11.4 parts of glutaric anhydride, to give 60 parts of the compound corresponding essentially to formula (11) as a brownish powder with a melting point of 35°–38° C. Acid number: 85.

APPLICATION EXAMPLES

Examples 5 to 8

To a fibre suspension which contains bleached birch sulfate pulp and pine sulfate pulp in a weight ratio of 1:1 in water of 10° (German water hardness), and which has a Schopper-Riegler freeness of 35° and a solids content of 0.5%, are added 20% of chalk as filler and then 0.01% of PERCOL ® 292 (cationic high molecular weight (MG $>1.10^7$) polyacrylamide) as auxiliary for retaining pulp fibre microparticles. The pH of the fibre suspension is as indicated in Table I below. The percentages refer to solids in filler and assistant, based on the solids content of the fibre suspension.

Formulations of the sizing agent are prepared by stirring 7% of each of the indicated sizing agents in powder form (obtained as crude product) with 3.5% of POLYMIN® P (polyethylenimine with a molecular weight of 10.000 to 100.000) as retention aid, in the presence of deionised water and of glass beads having a diameter 2 mm, at room temperature (15° to 25° C.). The dispersions so obtained are pourable, homogeneous and storage stable. The percentages refer to solids in fillers and retention aids, based on the total weight of the formulation.

The aqueous formulation of the sizing agent and the retention aid is then added to the fibre suspension in such a manner as to give 0,5% solids content of sizing agent, based on the solids content of the fibre suspension. The fibre suspension is then processed in a laboratory "Formette Dynamique" sheet former (supplied by Allimand, Grenoble, France) to paper sheets which, after they have been dried at 130° C. for 3 minutes, have a weight per unit area of 80 g/m$^2$.

Both surfaces of the paper sheets so obtained, i.e. the surface obtained on the wire side of the sheet former and the adjacent or top side, are tested for their sizing properties. This is done by measuring the water absorption according to Cobb over 30 seconds (WA Cobb$_{30}$) in accordance with DIN 53 132. The results of the WA Cobb$_{30}$ measurements in g/m$^2$ of the wire side (WS) and top side (TS) after drying at 130° C. and storage for 1 day at 23° C. and 50% relative humidity are reported in Table I. The lower the water absorption, the better the paper sizing. WA Cobb$_{30}$ values above 100 denote a completely unsatisfactory sizing of the paper.

TABLE I

| Example Nr. | Sizing agent | pH of the fibre suspension | WA Cobb$_{30}$ (g/m$^2$) after drying WS | TS | after storage for 1 day WS | TS |
|---|---|---|---|---|---|---|
| 5 | compound of Instruction A | 8.4 | 59 | 26 | 54 | 19 |
| 6 | compound of Instruction B | 8.4 | 42 | 14 | 31 | 13 |
| 7 | compound of Instruction C | 9.0 | 29 | 18 | 20 | 12 |
| 8 | compound of Instruction D | 8.0 | 36 | 18 | 36 | 17 |
| 9 | compound of Example 4 | 6.9* | 41 | 17 | 28 | 15 |

*fibre suspension without the addition of chalk

Similar results are obtained by replacing POLYMIN® P as cationic retentiton aid with CATO® 110 (cationically modified starch which is modified with a propylene oxide containing ammonium groups; pH of a 25% suspension is distilled water at 20° C.=4.2 to 4.6), POSAMYL® E7 (cationically modified starch with a nitrogen content of 0.4%), a native potato starch cationically modified with trimethylglycidylammonium chloride and having a nitrogen content of 1.3%, a condensate of dicyandiamide and triethylenetetramine which is further reacted with epichlorohydrin and is prepared in accordance with e.g. Example 2 of German "Offenlegungsschrift" No. 2,710,061, an adduct of epichlorohydrin and a reaction product of diethylenediamine and adipic acid, prepared in accordance with e.g. Example 1 of British Pat. No. 865,727, a reaction product of dicyandiamide, formaldehyde, ammonium chloride and ethylenediamine, prepared in accordance with e.g. Example 1 of U.S. Pat. No. 3,491,064, or RETAMINOL® K (polyethylenimine of mol wt 20,000 to 40,000). Mixtures of the retention aids of the above indicated kind are also suitable. To obtain good results, it can be advantageous to add dispersants, in particular condensates of formaldehyde and naphthalenesulfonic acids, or carboxymethyl cellulose. However, only a poor sizing with Cobb values of about 150 to 200 are obtained by using a sizing agent of Instruction A, B, C or D, or of Example 4, but without retention aid, or a retention aid of the above indicated kind but without a sizing agent.

Examples 10 to 15

The procedures of Examples 5 to 9 are repeated, except that the sizing agent and retention aid are added separately to the fibre suspension. The indicated amount (in %) of sizing agent is stirred, in powder form, at room temperature (15°-25° C.), in the presence of water and glass beads, with an aqueous 5% ammonia solution to give a self-emulsifying, pourable and storage stable emulsion, which can be further diluted, of the sizing agent formulations as indicated in Table II. The val % indicates the number of equivalents of ammonia for 100 equivalents, based on the number of acidic groups contained in the respective sizing agent. The indicated amount of the retention aid POLYMIN® P, expressed as solids, is added to the fibre suspension 10 seconds after the addition of the indicated amount of sizing agent, expressed as solids, said amounts being based on the solids content of the fibre suspension. The sizing results are also reported in Table II.

TABLE II

| Ex. Nr. | Formulation of the sizing agent | Amount of the sizing agent (%) | Amount of retention-aid (%) | pH of the fibre suspension | WA Cobb$_{30}$ (g/m$^2$) after drying WS | TS | after storage for 1 day TS | SS |
|---|---|---|---|---|---|---|---|---|
| 10 | 8.5% of the compound of Instruction C 100 val % of ammonia | 0.50 | 0.25 | 8.9 | 21 | 18 | 18 | 13 |
| 11 | 7% of the compound of Example 1 295 val % of ammonia | 0.50 | 0.25 | 9.0 | 24 | 14 | 23 | 14 |
| 12 | 8% of the compound of Example 2 100 val % of ammonia | 0.50 | 0.25 | 8.7 | 20 | 15 | 13 | 11 |
| 13 | 14% of the compound of Example 3 100 val % of ammonia | 0.50 | 0.25 | 8.7 | 24 | 16 | 19 | 14 |
| 14 | 10,7% of the compound of Example 4 100 val % of ammonia | 0.50 | 0.25 | 8.6 | 22 | 15 | 17 | 13 |
| 15 | 15% of the compound of Example 4 | 0.50 | 0.25 | 6.5* | 87 | 41 | 60 | 23 |

*fibre suspension without addition of chalk

Sizing results analogous to those reported in Table II are obtained by using from 10 to 200 val% of ammonia or sodium hydroxide (as 5% aqueous solutions) for formulating the sizing agent.

Similar results are also obtained by first adding the retention aid to the fibre suspension and subsequently adding the sizing agent 10 seconds later. The same also applies by dispensing with the addition of PERCOL® 292 and/or of a filler. Similar results are likewise obtained by using talcum as filler instead of chalk. Good sizing results are also obtained by using fibre suspensions which contain groundwood.

What is claimed is:

1. A process for sizing paper or cardboard under alkaline or neutral conditions, which comprises adding to aqueous cellulose-containing fiber suspensions which may or may not contain fillers and which, in the absence of acids or latent acid sulfates, have a pH value of at least 6.5, in any order or simultaneously, at least (A) one sizing agent devoid of anhydride groups which is a mono-N,N-$C_6$-$C_{22}$-dialkyl amide or N,N-$C_6$-$C_{22}$dialkenyl amide of a dicarboxylic acid, tricarboxylic acid or sulfocarboxylic acid or of a salt thereof, and (B) one polymeric cationic retention aid.

2. A process according to claim 1, wherein component (A) is a sizing agent of the formula

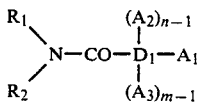

wherein $A_1$, $A_2$ and $A_3$ are each an anionic hydroxyl, carboxyl or sulfo group which is in salt or acid form, $D_1$ is an aromatic or cycloaliphatic divalent unsubstituted or halogen-substituted radical of 5 to 10 carbon atoms or unbranched or branched alkylene or alkenylene of 2 to 6 carbon atoms, each of $R_1$ and $R_2$ is $C_6$-$C_{22}$alkyl or $C_6$-$C_{22}$alkenyl, and n and m is each 1 or 2.

3. A process according to claim 1, wherein component (A) is a sizing agent of the formula

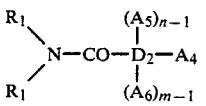

wherein $A_4$ is a sulfo or carboxyl group in salt or acid form, each of $A_5$ and $A_6$ is a hydroxyl or carboxyl group which is in the salt form or in the acid form, $D_2$ is naphthylene, phenylene, di- or tetrahydrophenylene, cyclohexylene, norbornenylene, hexachloronorbornenylene, $C_2$-$C_4$alkenylene or $C_2$-$C_6$alkylene, and $R_1$, n and m are as defined in claim 3.

4. A process according to claim 1 wherein the sizing agent employed as component (A) is a compound in the acid or salt form of the formula

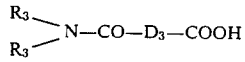

wherein $D_3$ is a divalent radical in the acid or salt form of the formula

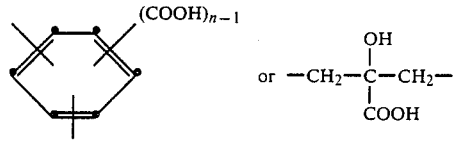

or a divalent radical of the formula

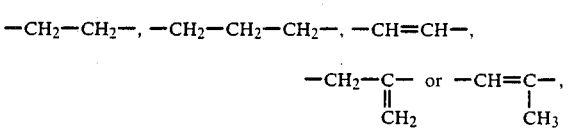

and $R_3$ is $C_{16}$-$C_{20}$alkyl or $C_{16}$-$C_{20}$alkenyl and n is 1 or 2.

5. A process according to claim 1, wherein the retention aid (B) has a molecular weight of 1000 to 2,000,000.

6. A process according to claim 1, wherein the retention aid (B) is selected from the group consisting of a polyalkylenimine, an adduct of epihalohydrin with a reaction product of a polyalkylenepolyamine and an aliphatic dicarboxylic acid; an adduct of epihalohydrin with a reaction product of a polyalkylenepolyamine, dicyandiamide and an organic dicarboxylic acid which is free or esterified with an alkanol; a reaction product of dicyandiamide, formaldehyde, an ammonium salt of a strong inorganic acid and an alkylenediamine or a polyalkylenepolyamine; a cationically modified starch or carbohydrate from carob bean gum or guar gum; a copolymer based on a polyamide amine or a reaction product of an epihalohydrin and a polymerised diallyl amine.

7. A process according to claim 1, which comprises using 0.02 to 3 percent by weight of the sizing agent (A) and 0.02 to 3 percent by weight of the retention aid (B), both amounts being expressed as solids in (A) and (B) and based on the solids content of the fibre suspension.

8. A process according to claim 1, wherein the fibre suspension has a pH of at least 7.0.

9. A process according to claim 1, wherein the fibre suspension has a pH of 7 to 9.

10. A process according to claim 1, wherein a filler is, said filler is selected from the group consisting of formaldehyde/urea condensate, titanium dioxide, talcum or chalk.

11. A process according to claim 10, wherein the filler is talcum or chalk.

12. A process according to claim 1, wherein the fibre suspension has a Schopper-Riegler freeness of 10° to 60° and a solids content of 0.1 to 5 percent by weight.

13. A process according to claim 1, wherein the fibre suspension contains pulp selected from the group consisting of sulfite, sulfate, groundwood, waste paper or mixtures thereof.

14. Paper or cardboard sized by a process according to claim 1.

* * * * *